US007633364B2

(12) United States Patent
Moffat et al.

(10) Patent No.: US 7,633,364 B2
(45) Date of Patent: Dec. 15, 2009

(54) DAMPENING APPARATUS AND CIRCUIT INTERRUPTER INCLUDING THE SAME

(75) Inventors: John R. Moffat, Greenwood, SC (US); Timothy G. Robirds, Sumter, SC (US)

(73) Assignee: Eaton Corporation, Cleveland, OH (US)

( * ) Notice: Subject to any disclaimer, the term of this patent is extended or adjusted under 35 U.S.C. 154(b) by 535 days.

(21) Appl. No.: 11/375,444

(22) Filed: Mar. 14, 2006

(65) Prior Publication Data

US 2007/0216503 A1 Sep. 20, 2007

(51) Int. Cl.
*H01H 9/00* (2006.01)

(52) U.S. Cl. ..... 335/175; 335/6; 200/400; 200/401; 200/288

(58) Field of Classification Search ..... 335/6–10, 335/15, 21, 175, 177; 200/400, 401, 288
See application file for complete search history.

(56) References Cited

U.S. PATENT DOCUMENTS 4,044,210 A 8/1977 Van Sickle
4,114,003 A 9/1978 Frink et al.
4,166,937 A 9/1979 Iman et al.
4,461,937 A 7/1984 Boni
4,612,429 A * 9/1986 Milianowicz ..... 200/288
5,571,255 A * 11/1996 Baginski et al. ..... 200/401
6,355,898 B1 * 3/2002 Gimeno et al. ..... 218/154
6,717,088 B2 * 4/2004 Kawamoto et al. ..... 218/84

* cited by examiner

*Primary Examiner*—Elvin G Enad
*Assistant Examiner*—Bernard Rojas
(74) *Attorney, Agent, or Firm*—Martin J. Moran

(57) ABSTRACT

A dampening apparatus has a housing with a plurality of first guide members and a plurality of second guide members coupled together. A first biasing member is located in an area proximate to the first guide members and within the housing. A first planar member is provided having a plurality of first apertures with the first guide members or the second guide members passing through the first apertures. A plurality of second planar members is provided having a plurality of second apertures with the second guide members passing through the second apertures. A plurality of second biasing members is located in an area proximate to the second guide members. An elongated shaft is coupled to the first planar member. The dampening apparatus could be included in a circuit interrupter.

3 Claims, 3 Drawing Sheets

DAMPENING APPARATUS AND CIRCUIT INTERRUPTER INCLUDING THE SAME

FIELD OF THE INVENTION

This invention generally relates to a dampening apparatus and, more particularly, to a dampening apparatus for a circuit interrupter or other device. The invention also relates to a circuit interrupter including a dampening apparatus.

BACKGROUND INFORMATION

Circuit interrupters provide protection for electrical systems from electrical fault conditions, by way of example and not limitation, current overloads, short circuits, trip conditions and abnormal level voltage conditions. Typically, circuit interrupters include an operating mechanism which opens separable contacts to interrupt the current through the conductors of an electrical system in response to abnormal conditions.

Switching devices (e.g., circuit interrupters, circuit breakers, switches, reclosers) include separable contacts disposed within a housing. Generally, in a vacuum circuit interrupter, for example, contacts are fixed relative to both the housing and to an external electrical conductor which is interconnected with the circuit to be controlled by the circuit interrupter. A number of other contacts are moveable. A moveable contact assembly usually comprises a stem of circular cross-section having the moveable contact at one end and an operating mechanism at the other end. The fixed contact is electrically coupled to or in electric communication with the moveable contact in response to the operating mechanism when the contacts are closed to energize the electrical system. The fixed contact and the moveable contact are not electrically coupled when the contacts are open to de-energize the electrical system.

Dampening apparatuses typically use a dampening device to avoid having a circuit interrupter re-close its separable contacts, due to rebounding upon opening of the electrical system. It is known to employ air piston dampening elements coupled to circuit interrupters. The problem with air piston dampening elements is that the dampening elements are susceptible to air borne contamination, such as dust and dirt. This could result in a jammed dampening apparatus which could cause problems with the circuit interrupter by allowing the circuit interrupter to re-close its separable contacts in an energized position.

Accordingly, there is room for improvement in dampening apparatuses. There is also room for improvement in circuit interrupters including a dampening apparatus.

SUMMARY OF THE INVENTION

It is an object of the invention to provide a dampening apparatus that is not susceptible to air borne contamination such as dust and dirt.

It is another object of the invention to provide a dampening apparatus that does not jam in order to avoid problems associated with a circuit interrupter coupled to a jammed dampening apparatus and to allow the circuit interrupter to re-close its separable contacts in an energized position.

As one aspect of the invention, a dampening apparatus has a housing with a plurality of first guide members and a plurality of second guide members coupled together. A first biasing member is located in an area proximate to the first guide members and within the housing. A first planar member is provided having a plurality of first apertures with the first guide members or the second guide members passing through the first apertures. A plurality of second planar members is provided having a plurality of second apertures with the second guide members passing through the second apertures. A plurality of second biasing members are located in an area proximate to the second guide members. An elongated shaft is coupled to the first planar member.

As another aspect of the invention, a circuit interrupter has separable contacts, and an operating mechanism is structured to open and close the separable contacts. The circuit interrupter is provided with a dampening apparatus that has a housing with a plurality of first guide members and a plurality of second guide members coupled together. A first biasing member is located in an area proximate to the first guide members and within the housing. A first planar member is provided having a plurality of first apertures with the first guide members or the second guide members passing through the first apertures. A plurality of second planar members are provided having a plurality of second apertures with the second guide members passing through the second apertures. A plurality of second biasing members are located in an area proximate to the second guide members. An elongated shaft is coupled to the first planar member. The elongated shaft is structured to be coupled to the operating mechanism. The first planar member moves along the first guide members or the second guide members in response to a trip condition in a circuit interrupter operating mechanism. The first biasing member is coupled to and biases the first planar member. The first planar member is structured to contact and move one of the second planar members, and the second biasing members are located in the area proximate to the second guide members to selectively bias the second planar members.

As another aspect of the invention, a dampening apparatus has a housing with a plurality of first guide members and a plurality of second guide members coupled together. A first biasing member is located in an area proximate to the first guide members and within the housing. A first planar member is provided having a plurality of first apertures with the first guide members or the second guide members passing through the first apertures and with the first planar member being structured to be biased along the first guide members or the second guide members in response to a trip condition in a circuit interrupter operating mechanism coupled to the dampening apparatus. A plurality of second planar members are provided having a plurality of second apertures with the second guide members passing through the second apertures. A plurality of second biasing members are located in an area proximate to the second guide members. An elongated shaft is coupled to the first planar member. The second planar members are structured to be biased along the second guide members in response to a circuit interrupter trip condition. The first biasing member has a first force and the second biasing members have a second force. The first force is greater than the second force.

DESCRIPTION OF THE PREFERRED EMBODIMENTS

Figure 1:
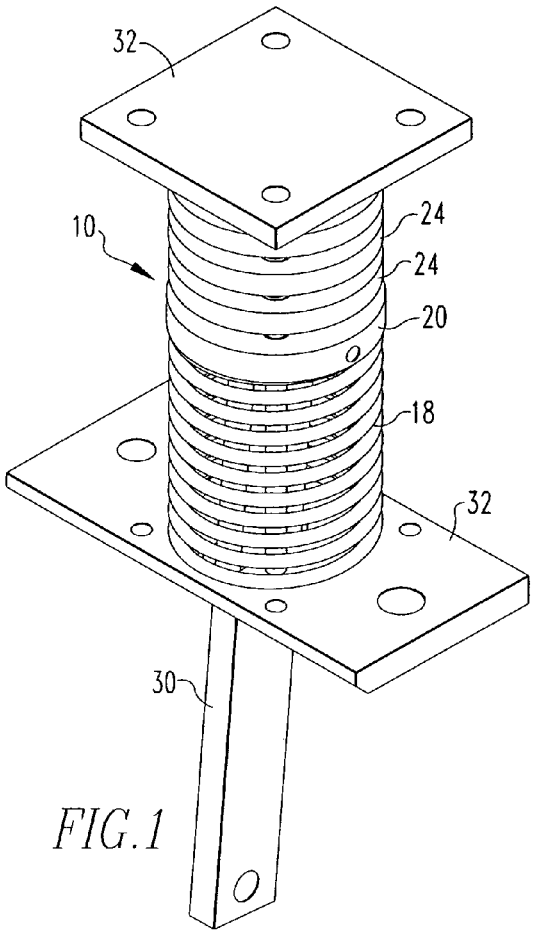
FIG. 1 is an isometric view of a dampening apparatus with the associated device in a closed position in accordance with an embodiment of the invention.

For purposes of the description hereinafter, the terms "upper", "lower", "vertical", "horizontal", "top", "bottom", "aft", "behind", "forward", "rear", "beneath", "below" and derivatives thereof shall relate to the structures as oriented in the drawings. However, it is to be understood that the invention may assume various alternative configurations except where expressly specified to the contrary. It is also to be understood that the specific elements illustrated in the drawings and described in the following specification are simply exemplary embodiments of the invention. Therefore, specific dimensions, orientations and other physical characteristics related to the embodiments disclosed herein are not to be considered limiting.

As employed herein, the term "number" refers to one or to an integer greater than one (i.e., a plurality).

As employed herein, the term "fastener" refers to any suitable fastening, connecting or tightening mechanism expressly including, but not limited to, integral rivets.

As employed herein, the statement that two or more parts are "coupled", "attached" or "connected" together shall mean that the parts are joined together either directly or joined through one or more intermediate parts.

Figure 3:
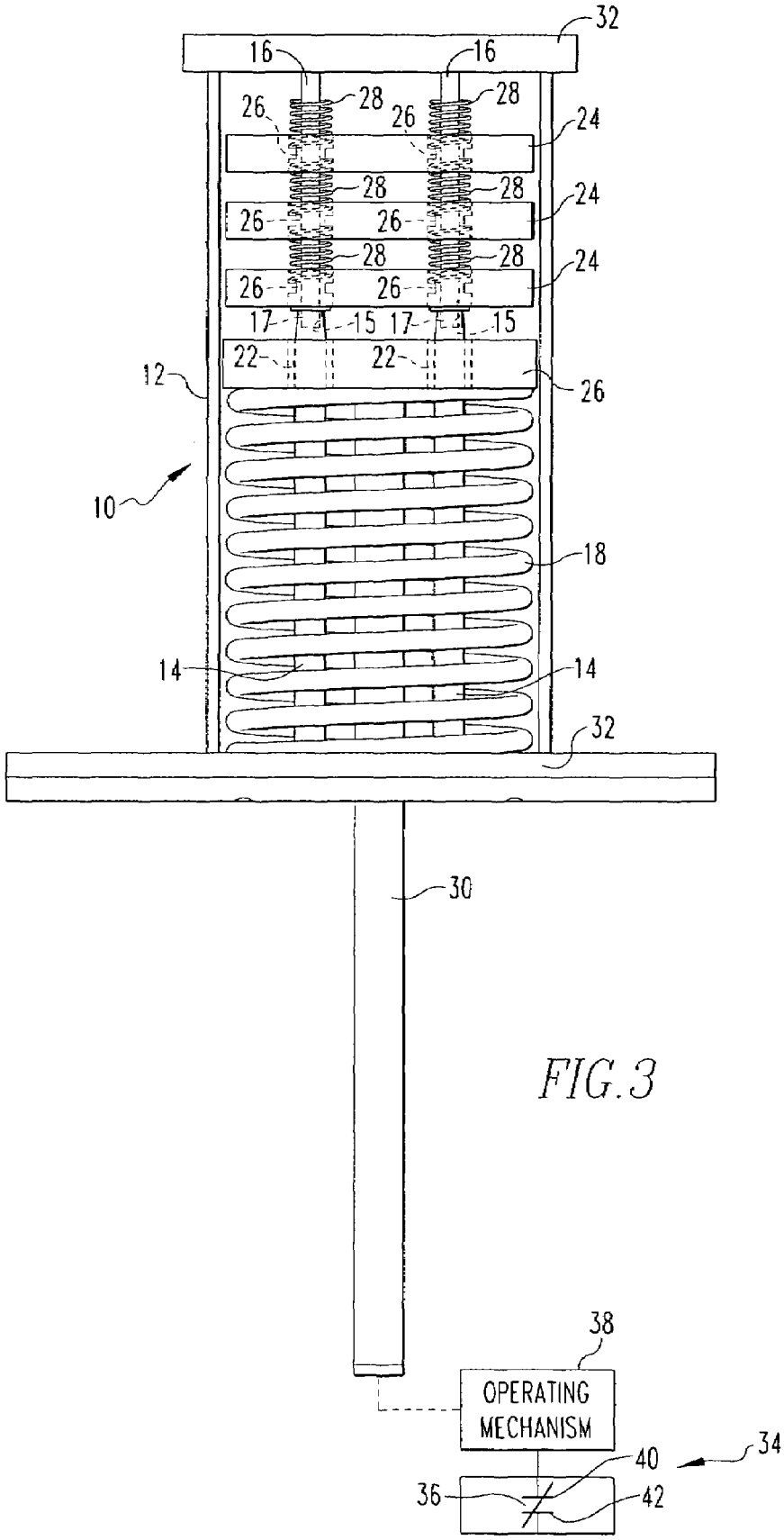
FIG. 3 is a vertical elevation view of the dampening apparatus of FIG. 1 shown coupled in schematic fashion to an operating mechanism of a circuit interrupter that has separable contacts in a closed position.

Turning to FIGS. 1 and 3, a dampening apparatus 10 is shown with the device in the closed position. The dampening apparatus 10 has a housing 12 (FIG. 3) with a plurality of first guide members 14 and a plurality of second guide members 16 coupled together. The first guide members 14 and the second guide members 16 may have a preselected shape, which may be, by way of example and not limitation, pins, shafts, spindles, stems or rods. The first guide members 14 and the second guide members 16 may have a rounded or non-rounded outer diameter. The first guide members 14 have a bore 15 and the second guide members 16 have a tip 17 with the tips 17 and bores 15 coupled together. The first guide members 14 and the second members 16 are shown as separate elements, but one of ordinary skill in the art would appreciate that the first guide members 14 and the second guide members 16 could be integrally connected together.

A first biasing member 18 is located in an area proximate to the first guide members 14 and within the housing 12. The first biasing member 18 is also located around the first guide members 14 and within the housing 12.

A first planar member 20 is provided having a plurality of first apertures 22 (shown in hidden lines) with the first guide members 14 or the second guide members 16 passing through the first apertures 22. A plurality of second planar members 24 is provided having a plurality of second apertures 26 (shown in hidden lines) with the second guide members 16 passing through the second apertures 26. The first apertures 22 and the second apertures 26 may have a complementary rounded or non-rounded inner diameter to the outer diameter of the first guide members 14 or the second guide members 16. The first planar member 20 and the second planar members 24 may have a preselected shape, which may be, by way of example and not limitation, plates, sheets or rings. The first planar member 20 and the second planar members 24 may have a rounded or non-rounded outer diameter.

A plurality of second biasing members 28 is located in an area proximate to the second guide members 16. The second biasing members 28 are also located around the second guide members 16 and within the housing 12. The second biasing members 28 are structured to be seated within one or more of the second apertures 26. The first biasing member 18 has a first force and the second biasing members 28 have a second force with the first force being greater than the second force.

Figure 2:
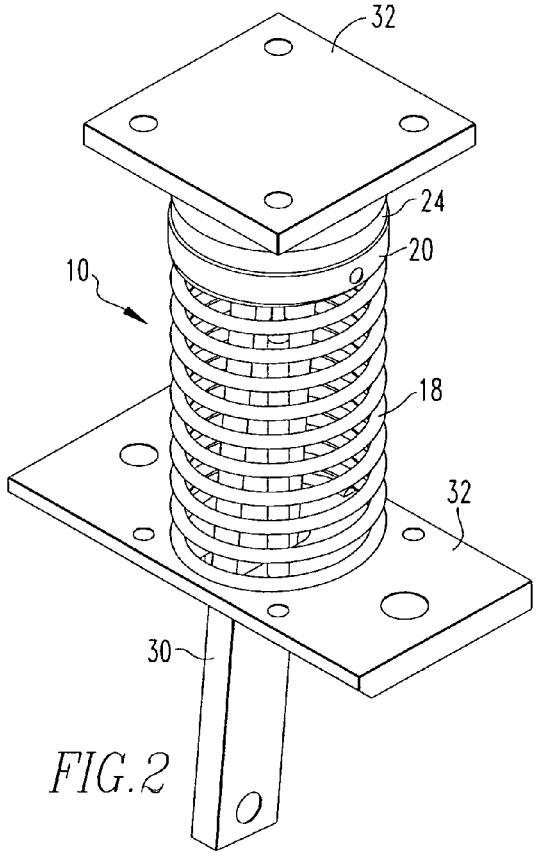
FIG. 2 is an isometric view of the dampening apparatus with the associated device in an open position in accordance with an embodiment of the invention.

An elongated shaft 30 is coupled to the first planar member 20, by way of example and not of limitation, through a mechanical coupling, pivot attachment or the like. Also, a plurality of plates 32 encases the housing 12. As can be appreciated, the encasement of the housing 12 with plates 32 eliminates the air borne contamination problem with the prior art air piston and complicated relief valve system that jammed prior art dampening apparatuses. The disclosed dampening apparatus 10 eliminates the jamming problem associated with prior art air piston systems and the possibility of the planar members 20, 24 bouncing back and allowing the separable contacts 36 of the circuit interrupter 34 to re-close (from the open position of FIGS. 2 and 4) in an energized position. The housing 12 and plates 32 that encase the dampening apparatus 10 keep the dampening apparatus 10 free from air borne contamination such as dust and dirt to avoid jamming problems. Jammed dampening apparatuses are dangerous since the jammed apparatus could allow a circuit interrupter to re-close its separable contacts in an energized position when it is not desired to re-energize the electrical system.

Figure 4:
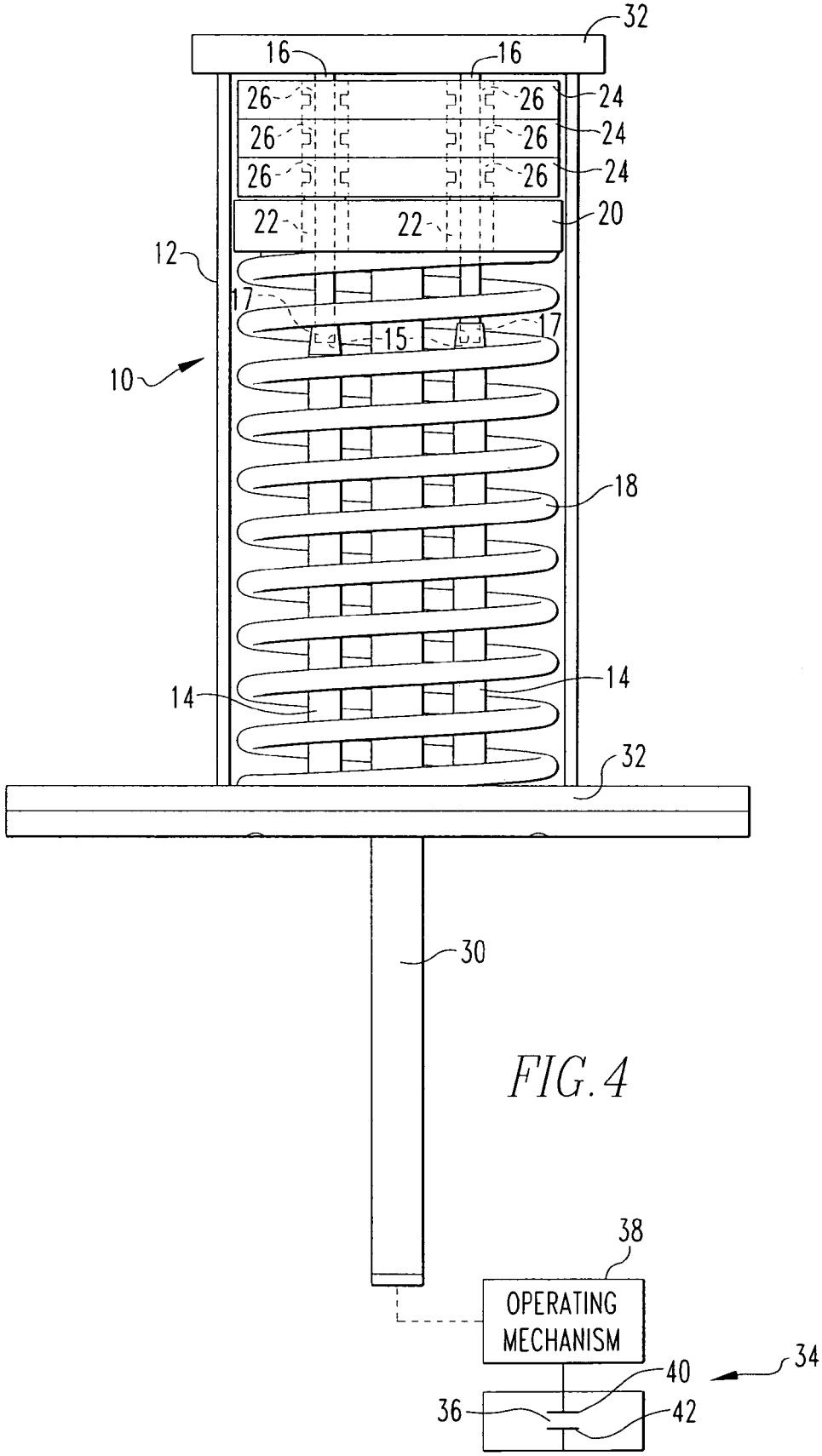
FIG. 4 is a vertical elevation view of the dampening apparatus of FIG. 2 shown coupled in schematic fashion to the operating mechanism of the circuit interrupter that has separable contacts in an open position.

With reference to FIGS. 3 and 4, the dampening apparatus 10 is shown coupled to a circuit interrupter 34 having separable contacts 36 and an operating mechanism 38. The operating mechanism 38, as shown in FIG. 3, is structured to drive moveable contact 40 into electric communication with a fixed contact 42 to energize the electrical system (not shown) to which the circuit interrupter 34 is coupled. The operating mechanism 38, as shown in FIG. 4, is also structured to drive moveable contact 40 out of electric communication with the fixed contact 42 to de-energize the electrical system to which the circuit interrupter 34 is coupled. In other words, the operating mechanism 38 is structured to open and close the separable contacts 36 of the circuit interrupter 34.

In the event of an electrical fault condition, by way of example and not of limitation, current overloads, short circuits, trip conditions and abnormal level voltage conditions, the moveable contact 40 of the circuit interrupter 34 moves out of electrical communication with the fixed contact 42 to de-energize the electrical system to which the circuit interrupter 34 is coupled. After the trip condition, the operating mechanism 38 coupled to the moveable contact 40 drives the moveable contact 40. The operating mechanism 38 coupled to the elongated shaft 30 moves the elongated shaft 30 to another position and the dampening apparatus 10 is activated through the movement of the elongated shaft 30 to dampen the movement of the operating mechanism 38 that occurred as a result of the trip condition that occurred in the circuit interrupter 34.

In response to the trip condition in the circuit interrupter 34, the elongated shaft 30 moves first planar member 20 to another position due to the clearance fit between the first guide members 14 and the first apertures 22. In other words, the first planar member 20 lifts upward or to another plane which releases the first biasing member 18 from a compressed state to bias first planar member 20 along the first guide members 14 of the second guide members 16. The first planar member 20 can move to another position, upward or to another plane due to the clearance fit between the first guide members 14 and the first apertures 22. The first planar member 20 moves along the first guide members 14 or the second guide members 16 through biasing movement supplied by the first biasing member 18. The first biasing member 18 is coupled to and biases the first planar member 20 along the first guide members 14 or the second guide members 16 in response to the trip condition in the circuit interrupter 34. The first planar member 20 is structured to contact and move one of the second planar members 24. The second biasing members 28 (FIG. 3) that are located in the area proximate to the second guide members 16 selectively bias the second planar members 24 along the second guide members 16 in response to the trip condition in the circuit interrupter 34.

While the dampening apparatus 10 is shown in connection with a circuit interrupter 34, one of ordinary skill in the art would appreciate that the dampening apparatus 10 could, by way of example and not limitation, be employed by other devices such as a network protector, an electrical switching apparatus or the like. Once the dampening apparatus 10 is in the open position shown in FIGS. 2 and 4, the elongated shaft 30 coupled to the operating mechanism 38 is structured to be activated to close separable contacts 36 of the circuit interrupter 34. Movement of the elongated shaft 30 to place the dampening apparatus 10 back in the closed position (FIGS. 1 and 3) would drive operating mechanism 38. In turn, operating mechanism 38 would drive moveable contact 40 into electric communication with the fixed contact 42 to re-energize the electrical system to which the circuit interrupter 34 is coupled.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended hereto and any and all equivalents thereto.

What is claimed is:

1. A circuit interrupter comprising:

separable contacts;

an operating mechanism structured to open and close the separable contacts; and a dampening apparatus comprising:

a housing comprising a plurality of first guide members and a plurality of second guide members coupled together;

a first biasing member located in an area proximate to the first guide members and within the housing;

a first planar member having a plurality of first apertures with the first guide members or the second guide members passing through the first apertures;

a plurality of second planar members having a plurality of second apertures with the second guide members passing through the second apertures;

a plurality of second biasing members located in an area proximate to the second guide members;

an elongated shaft coupled to the first planar member, wherein the elongated shaft is coupled to the operating mechanism, wherein the first planar member moves along the first guide members or the second guide members in response to a trip condition in a circuit interrupter operating mechanism, wherein the first biasing member is coupled to and biases the first planar member, wherein the first planar member is structured to contact and move one of the second planar members, wherein the second biasing members are located in the area proximate to the second guide members to selectively bias the second planar members; and wherein a plurality of plates encase the housing.

2. A dampening apparatus comprising:

a housing comprising a plurality of first guide members and a plurality of second guide members coupled together;

a first biasing member located in an area proximate to the first guide members and within the housing;

a first planar member having a plurality of first apertures with the first guide members or the second guide members passing through the first apertures and with the first planar member being structured to be biased along the first guide members or the second guide members in response to a trip condition in a circuit interrupter operating mechanism coupled to the dampening apparatus;

a plurality of second planar members having a plurality of second apertures with the second guide members passing through the second apertures;

a plurality of second biasing members located in an area proximate to the second guide members;

an elongated shaft coupled to the first planar member, wherein the second planar members are structured to be biased along the second guide members in response to a circuit interrupter trip condition, and wherein the first biasing member has a first force and the second biasing members have a second force, wherein the first force is greater than the second force; and wherein a plurality of plates encase the housing.

3. A dampening apparatus comprising:

a housing comprising a plurality of first guide members and a plurality of second guide members coupled together;

a first biasing member located in an area proximate to the first guide members and within the housing;

a first planar member having a plurality of first apertures with the first guide members or the second guide members passing through the first apertures and with the first planar member being structured to be biased along the first guide members or the second guide members in response to a trip condition in a circuit interrupter operating mechanism coupled to the dampening apparatus;

a plurality of second planar members having a plurality of second apertures with the second guide members passing through the second apertures;

a plurality of second biasing members located in an area proximate to the second guide members;

an elongated shaft coupled to the first planar member, wherein the second planar members are structured to be biased along the second guide members in response to a circuit interrupter trip condition, and wherein the first biasing member has a first force and the second biasing members have a second force, wherein the first force is greater than the second force; and wherein the first guide members have a bore and the second guide members have a tip, and wherein the tips and the bores are coupled together.

* * * * *